United States Patent [19]

Heffner et al.

[11] 4,218,725

[45] Aug. 19, 1980

[54] EMERGENCY LIGHT

[76] Inventors: Ronald J. Heffner, 370 Rte. 22, Greenbrook, N.J. 08812; Russell Lee, 3 Patrick St., Carteret, N.J. 07008

[21] Appl. No.: 3,206

[22] Filed: Jan. 15, 1979

[51] Int. Cl.[2] ..... F21V 19/04

[52] U.S. Cl. ..... 362/20; 362/183

[58] Field of Search ..... 362/183, 20

[56] References Cited

U.S. PATENT DOCUMENTS 2,478,129 8/1949 Powell ..... 362/20

*Primary Examiner*—Stephen J. Lechert, Jr.

*Attorney, Agent, or Firm*—Roger A. Clapp

[57] ABSTRACT

An emergency light unit is disclosed in which a relay controlled low voltage bulb is initially responsive to line voltage and alternately responsive to battery voltage. A test switch is included to permit instant determination of line voltage and battery status.

7 Claims, 3 Drawing Figures

EMERGENCY LIGHT

BACKGROUND OF THE INVENTION

1. Field of the Invention

This invention relates to emergency lighting units and pertains to those in which auxiliary lighting is provided by a battery source.

2. Description of the Prior Art

While emergency light units are available which provide illumination when line voltage fails, none has proved entirely satisfactory. Typically, the lighting unit is not lit when line voltage is operative and only lights when line voltage fails.

Accordingly, one object of this invention is to achieve lighting in response to line voltage as well as to battery voltage.

Auxiliary lighting sources which depend on battery power must provide some means for checking battery condition. Where the light source is enabled alternately by line voltage or battery voltage, some method is required for determining the respective states.

Accordingly, another object of this invention is to achieve instant indication of the status of line voltage and battery condition.

SUMMARY OF THE INVENTION

In accordance with the preferred embodiment of this invention, a relay, a converter and a battery cooperate to alternately provide power to a low voltage bulb.

In accordance with one feature of this invention, the low voltage bulb is enabled through a relay which applies line voltage to the bulb when energized and applies battery voltage to the bulb when de-energized.

In accordance with another feature of this invention, the relay is operatively responsive to a test switch wherein battery voltage is applied to the bulb and line voltage is removed when the switch is operated whereby the status of each is instantly indicated when the test switch is operated.

These and other objects and features of this invention will be more readily understood by reference to the following detailed description and drawing.

DETAILED DESCRIPTION OF THE INVENTION

Figure 3:
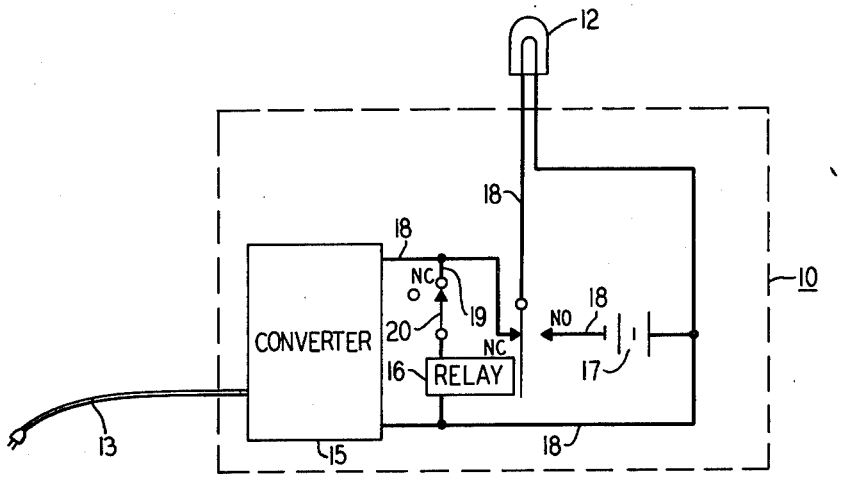
FIG. 3 is a schematic drawing of the operative elements in the light unit depicted in FIGS. 1 and 2.
Figure 1:
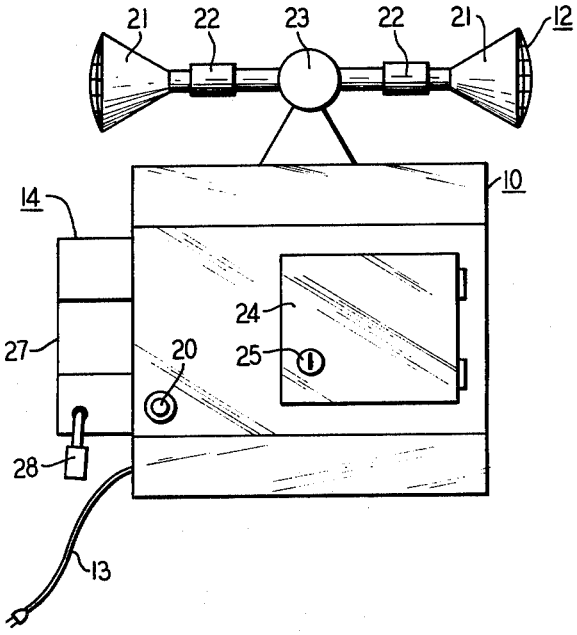
FIG. 1 is a front elevation view of a light unit made in accordance with this invention.
Figure 2:
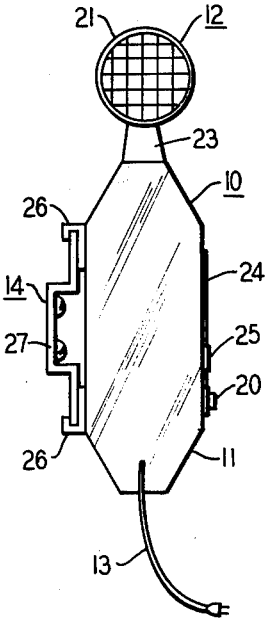
FIG. 2 is an end elevation view of the light unit shown in FIG. 1.

Referring to FIGS. 1 and 2, a switch unit 10 is disclosed which comprises a case 11, a light assembly 12, a power cord 13 and a mounting assembly 14. Referring to FIG. 3, the light assembly 12 and the power cord 13 are electrically linked by a converter 15, relay 16, battery 17 and leads 18 and 19 respectively.

In the embodiment illustrated in FIG. 3, the relay 16 is normally energized when the power cord is connected to a power source. As a result, the output of the converter 15 is connected across the terminals of the light assembly 12 so as to apply line voltage thereto thereby causing the unit to light up. When the power cord 13 is disengaged from the power source or the power source fails, the relay 16 de-energizes and, as a result, the relay contacts switch the output of the battery 17 to the terminals of the light assembly 12 thereby maintaining illumination by the unit. Obviously, the line voltage and battery must be the same and, in the embodiment illustrated, it is 12 volts as is the rating of the bulbs. The converter 15 is state of the art and the battery 17 is advantageously a 12 volt dry cell.

The lead 19 to the relay 16, however, includes a test switch 20 which is normally closed. When the test switch 20 is operated, the relay 16 disengages and the contacts switch battery voltage across the terminals of the light unit 12. The result is an instantaneous indication of the status of the system. Specifically, if line voltage has failed, pressing the test switch 20 will have no effect thereby indicating failure of the power source. On the other hand, if the power source is good, the transfer from line voltage to battery voltage will produce a visual flicker, audible click or both. Obviously, if the battery 17 is defective, no flicker or click will occur and the light unit 12 will fail to light.

The light assembly 12 may comprise one or more bulbs 21 (two are disclosed herein) which, in turn, are adjustably mounted on arms 22 terminating in an adjustable head 23. The head 23 is attached to the case 11 which houses the circuit elements and may advantageously be made of metal. The two ends of the case 11 may be tapered to facilitate bulb positioning and the front includes the test switch 20 and a hinged access door 24 secured by a lock 25. The mounting unit 14 supports the case 11 and comprises two slides 26 and a bracket 27. The slides 26 are mounted in opposed relationship on the back of the case 11 and the bracket 27 is screwed or bolted in place on a wall or other mounting location. If desired, a lock 28 can be installed to prevent unauthorized removal.

In summary, a lighting unit has been disclosed which provides continuous lighting regardless of the state of line voltage and in which the status of the line voltage and battery can be instantaneously determined. While only one embodiment has been disclosed, it is illustrative of the principals of this invention and it is anticipated that other embodiments falling within the scope of the invention will readily occur to those skilled in the art.

What I claim is:

1. An emergency lighting unit comprising:

a light assembly having at least one bulb rated at low voltage;

converter means for transforming line voltage to said low voltage;

battery means having a potential equal to said low voltage;

relay means for connecting the low voltage of said converter means to said bulb when energized and for connecting the low voltage of said battery to said bulb when de-energized, said relay means being normally energized when line voltage is applied to said converter means;

circuit leads for interconnecting said line voltage, converter means, bulb, battery means and relay;

case means for housing said light assembly, converter means, battery means, relay and current leads, and switch means for disabling said relay whereby the status of said line voltage and said battery is instantly determined.

2. An emergency lighting unit in accordance with claim 1 wherein said bulb can be multiple positioned.

3. An emergency lighting unit in accordance with claim 1 wherein said bulb is rated at 12 volts.

4. An emergency lighting unit in accordance with claim 3 wherein said battery is a 12 volt dry cell and said housing includes a door for access to said battery.

5. An emergency lighting unit in accordance with claim 1 wherein said emergency lighting unit includes two twelve volt bulbs.

6. An emergency lighting unit in accordance with claim 5 wherein both of said light bulbs are adjustable.

7. An emergency lighting unit in accordance with claim 1 wherein said case includes a slide mount for easy installation.

* * * * *